United States Patent [19]

Eheim et al.

[11] 4,249,497

[45] Feb. 10, 1981

[54] FUEL INJECTION APPARATUS HAVING AT LEAST ONE FUEL INJECTION VALVE FOR HIGH-POWERED ENGINES

[75] Inventors: Franz Eheim; Max Straubel, both of Stuttgart, Fed. Rep. of Germany

[73] Assignee: Robert Bosch GmbH, Stuttgart, Fed. Rep. of Germany

[21] Appl. No.: 966,541

[22] Filed: Dec. 5, 1978

[30] Foreign Application Priority Data

Dec. 31, 1977 [DE] Fed. Rep. of Germany ..... 2759187

[51] Int. Cl.[3] ..... F02M 47/02; F02M 51/00

[52] U.S. Cl. ..... 123/446; 123/467

[58] Field of Search ..... 123/139 DP, 139 E, 139 AS, 123/139 AT; 239/533.8, 124, 95, 574

[56] References Cited

U.S. PATENT DOCUMENTS

| | | | |
|---|---|---|---|
| 3,464,627 | 9/1969 | Huber | 123/139 E |
| 3,481,542 | 12/1969 | Huber | 239/533.8 |
| 3,625,192 | 12/1971 | Dreisin | 123/139 AT |
| 3,752,136 | 8/1973 | Knight | 123/139 DP |
| 3,802,626 | 4/1974 | Regneault | 239/533.8 |
| 3,952,711 | 4/1976 | Kimberley | 123/139 AT |
| 3,983,855 | 10/1976 | Jarrett | 123/139 E |
| 4,019,481 | 4/1977 | Lakra | 123/139 E |
| 4,064,855 | 12/1977 | Johnson | 123/139 DP |
| 4,069,800 | 1/1978 | Kanda | 123/139 E |
| 4,164,326 | 8/1979 | Deckard | 123/139 E |

*Primary Examiner*—Charles J. Myhre
*Assistant Examiner*—Carl Stuart Miller
*Attorney, Agent, or Firm*—Edwin E. Greigg

[57] ABSTRACT

A fuel injection apparatus particularly suitable for high-powered engines, in which the pressure chamber of the fuel injection valve or valves is relieved of pressure during the pauses between injections by means of a correspondingly controlled obturation mechanism so that, when the valves are not tight, the undesirable injection of fuel during the pauses between injections is substantially prevented.

20 Claims, 4 Drawing Figures

FUEL INJECTION APPARATUS HAVING AT LEAST ONE FUEL INJECTION VALVE FOR HIGH-POWERED ENGINES

BACKGROUND OF THE INVENTION

The invention relates to a fuel injection apparatus of the type such as is shown in German laid-open application No. 1,807,965. In this apparatus, the fuel delivery line, which has a constant pressure of approximately 1000 bar, is in continuous direct communication with the pressure chamber. It is disadvantageous, however, that if the valves are not tight, the fuel is continually injected because it is at a constant high pressure and there is a correspondingly high leakage flow. As a result, incomplete combustion takes place, causing smoking and sooting. In addition, the oil film can be washed off by the fuel which is injected in excess amounts and hence unconsumed, which can lead to piston corrosion and/or seizing and to significant damage.

OBJECT AND SUMMARY OF THE INVENTION

The object of the present invention is to provide an improved fuel injection apparatus such that even when the fuel injection valve is not tight, practically no leakage flow arises, or at the most, there is only a very small leakage flow, which is held to a minimum particularly during the pauses between injections.

To attain this object, it is proposed that an obturation mechanism controlled in synchronism with the injection be provided in the fuel delivery line leading to the pressure chamber. By means of this obturation mechanism, the connecting line between the pressure chamber and the fuel delivery line is interrupted during at least a major portion of the pause between injections, and is opened for a period of time which is somewhat longer than the duration of injection.

As a result of the interruption of the connecting line between the pressure chamber and the fuel delivery line during the pauses between injections, when the fuel injection valve is not tight, no fuel under pressure can escape, so that the leakage flow quantity is substantially smaller than in the conventional, known fuel injection valves.

More specifically, in high-powered engines, the obturation mechanism can be a control slider which is preferably servo-controlled.

In a particularly advantageous manner, the leakage flow can be significantly reduced further by an arrangement wherein the connecting line which leads to the pressure chamber is connectable by means of the obturation mechanism first with the fuel delivery line during the duration of injection, and then with a return line during the pauses between injections. In this manner, a substantial pressure relief is attained in the pauses between injections, so that during the period when there is practically no pressure, no fuel can escape from a loose fuel injection valve.

In internal combustion engines of high performance and uncooled, or poorly cooled, fuel injection valves, bubbles can form in the pressure chamber when the valves are in the pressureless state. This can result in significant disturbances and particularly in strong pressure surges. It is therefore desirable to provide a check valve in the return line, by means of which a minimum pressure (standing pressure) is advantageously maintained in the pressure chamber during the pauses between injections.

The control slider can have a throttle cross section which is only effective in the opening phase, when the fuel delivery line is connected with the pressure chamber, in order to avoid an excessively rapid pressure rise, with the concommitant pressure peaks of reflected pressure waves.

A further reduction of pressure fluctuations with a simultaneous reduction in the line diameters and pump output required can be obtained by providing a reservoir chamber upstream of the obturation mechanism.

In order to conserve energy, the control slider may be servo-controlled by a magnetic valve which is in itself controlled by a control means. Then the servo pressure employed as the control means is lower than the fuel injection pressure, for example, approximately 200 bar as compared with 1000 bar.

Because the obturation mechanism connects the pressure chamber only briefly with the return line after injection has taken place and then provides a complete obturation, a warning transducer can be provided which transmits a warning or stops the engine, if the pressure in the connecting line leading to the pressure chamber falls below a minimum pressure level; this is always the case when the fuel injection valve is not tight. The warning transducer may advantageously be disposed in the return line upstream of the check valve, so that the maximum pressure exerted on the warning transducer is only that pressure which has been reduced by means of the check valve and thus the warning indicator need not be capable of withstanding high pressure.

In a preferred embodiment of a fuel injection apparatus with at least two fuel injection valves with mutually out-of-phase injection timing, the servo-controlled control slider may be controlled via a mechanical distributor.

The distributor has a distributor shaft coupled with the engine crankshaft which rotates once per crankshaft rotation in a two-cycle engine and once every two crankshaft rotations in a four-cycle engine. This distributor shaft has control slots and control grooves by means of which, over a period of time somewhat longer than the duration of injection, a pressure chamber of the control slider is connected with a servo pressure line and subsequently, at least briefly, with the nearly pressureless return line. By this means, the control slider path is reversed as a result of a spring which pushes the control slider into the relief position; this takes place in each case for the obturation mechanism associated with each fuel injection valve.

In high-powered engines, the valve body of the fuel injection valve is controlled by a control means via an auxiliary valve and the auxiliary valve in turn by a magnetic valve. The magnetic valve which controls the auxiliary valve and the control slider which controls the relief of the pressure chamber can now be embodied as a structural unit and this structural unit can be servo-controlled via a magnetic valve. By this means, the time intervals between the pressurizing of the pressure chamber of the fuel injection nozzle and the opening thereof for the purpose of injecting the fuel can be kept particularly short, without inhibiting the pressure buildup in the pressure chamber. The pressure drop after injection takes place can also be initiated equally fast, so that an after-injection because of possible pressure fluctuations is positively prevented.

The control of many fuel injection valves of a multi-cylinder engine as well is accomplished in a simple manner by providing the structural unit with a control slider with two control grooves, where the connecting line to the pressure chamber of the fuel injection valve can be connected by means of the first control groove alternatively with the fuel delivery line or with the return line, while an upper pressure chamber of the auxiliary valve can be connected by means of the second control groove alternatively with the servo pressure line or the return line. The overlap of the control grooves by the control edges is smaller in the case of the first control groove than in the case of the second control groove, so that it is assured that the pressure buildup in the pressure chamber is terminated before the beginning of injection and that an obturation of the connecting line to the pressure chamber takes place only after the termination of the injection process.

By means of a position feedback means coupled either electrically or electronically with the control slider, the feedback signal required for the control and for the ascertainment of possible disturbances can be picked up without any delay.

In addition, in smaller fuel injection apparatures, a mechanically controlled distributor can also be directly provided as the obturation mechanism, by means of which a substantial simplification of the design of the fuel injection apparatus is possible.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
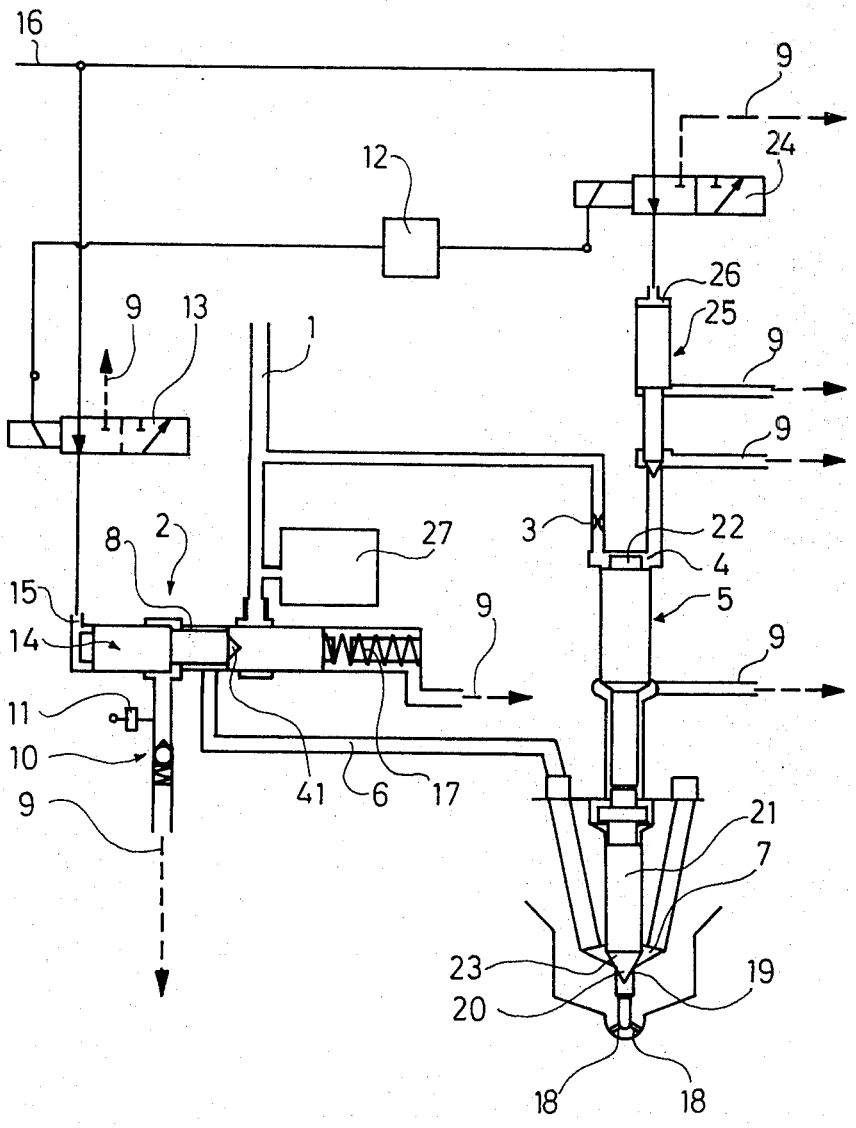
FIG. 1 is a schematic representation of a first embodiment of a fuel injection apparatus with magnetic valve control constructed in accordance with the invention.

In the drawings, the same reference numerals are used to indicate all parts which correspond with each other. Turning now to the first embodiment of the invention shown in FIG. 1, there is a fuel delivery line 1 under high pressure, 1000 bar, for example, which communicates first with an obturation mechanism 2 and then via a throttle 3 with an upper pressure chamber 4 of a fuel injection valve 5.

The obturation mechanism 2 is a $\frac{2}{3}$-way valve wherein in its position of rest, a connecting line 6, which communicates with a pressure chamber 7 of the fuel injection valve 5, is connected via a control groove 8 with a return line 9. The return line 9 is virtually pressureless. In order to prevent bubble formation in the pressure chamber 7 of the fuel injection valve 5, a check valve 10 is provided in the return line 9, by means of which a minimal pressure, 20 atmospheres, as an example, is maintained in the pressure chamber 7 and in the connecting line 6. A warning transducer 11 may be provided upstream of the check valve 10, by means of which a warning signal is transmitted if the pressure in the connecting line 6 falls below a certain permissible pressure during operation. This occurs whenever the fuel injection valve 5 is not tight.

A pressure chamber 15 can be connected with a servo pressure line 16 or with the return line 9 via a magnetic valve 13 controlled by a control means 12, in order to effect servo control of a control slider 14 of the obturation mechanism 2. The pressure of the servo pressure line 16 may be, as an example, approximately 200 bar. When the pressure chamber 15 is pressurized, the control slider 14 having a throttle cross section 41 is displaced against a spring 17 and thus the fuel delivery line 1 is in communication via the control groove 8 with the connecting line 6 leading to the pressure chamber 7. Thus, the pressure of the fuel delivery line 1 also prevails in the pressure chamber 7.

An ejection of the fuel through the nozzle bores 18 is not possible, because the flow thereto is blocked by a valve needle 20 of a circularly cylindrical valve body 21, the valve needle 20 being seated on a valve seat 19. The valve body 21 is guided for axial displacement within a housing, which is not shown in further detail. A front face 22 of the valve body 21, which may be formed in several parts if desired, projects into the upper pressure chamber 4, which communicates with the fuel delivery line 1 via the throttle 3. The diameter of the front face 22 has a larger effective cross-sectional area than does the face 23 of the valve body 21 which projects into the pressure chamber 7, so that the valve needle 20 remains firmly pressed against the valve seat 19.

In order to initiate the injection of fuel, an auxiliary valve 25 is opened which is controlled by the control means 12 by way of a magnetic valve 24. For this purpose, an upper pressure chamber 26 is connected via the magnetic valve 24 with the return line 9 and thus the upper pressure chamber 4 of the fuel injection valve 5 is also connected with the return line 9. With this arrangement, the pressure drops in the upper pressure chamber 4 of the fuel injection valve 5, and the valve body 21 can move upward as a result of the pressure in the pressure chamber 7, in order to initiate the fuel injection.

By switching over the magnetic valve 24, the upper pressure chamber 26 of the auxiliary valve 25 is subjected to the pressure of the servo pressure line 16, and thus the auxiliary valve 25 is closed. As a result of the fuel flowing through the throttle 3, the pressure rises in the upper pressure chamber 4 of the fuel injection valve 5 and displaces the valve body 21 downward, so that the valve needle 20 is again firmly seated on the valve seat 19 and the injection is terminated. Shortly thereafter, the magnetic valve 13 is also switched over via the control means 12, which places the pressure chamber 15 of the obturation mechanism 2 in communication with the return line 9, so that the control slider 14 is again displaced back into its position of rest by the spring 17. This action also effects the pressure relief of the pressure chamber 7 via the connecting line 6 and the return line 9. Thus, should the valve seat 19 be loose, only a small leakage flow arises.

By means of the somewhat longer opening time for the magnetic valve 13 compared with that of the magnetic valve 24, it is assured that sufficient time remains, before the actual injection occurs, for the pressure buildup to take place in the pressure chamber 7. A rapid refilling of fuel can be effected more easily in that a reservoir chamber 27 is provided upstream of the obturation mechanism 2, while, at the same time, pressure fluctuations and pressure surges in the fuel delivery line are lessened as a result. Through the provision of a reservoir chamber 27, the diameter of the fuel delivery line 1 and the associated fuel pump can be reduced.

Figure 2:
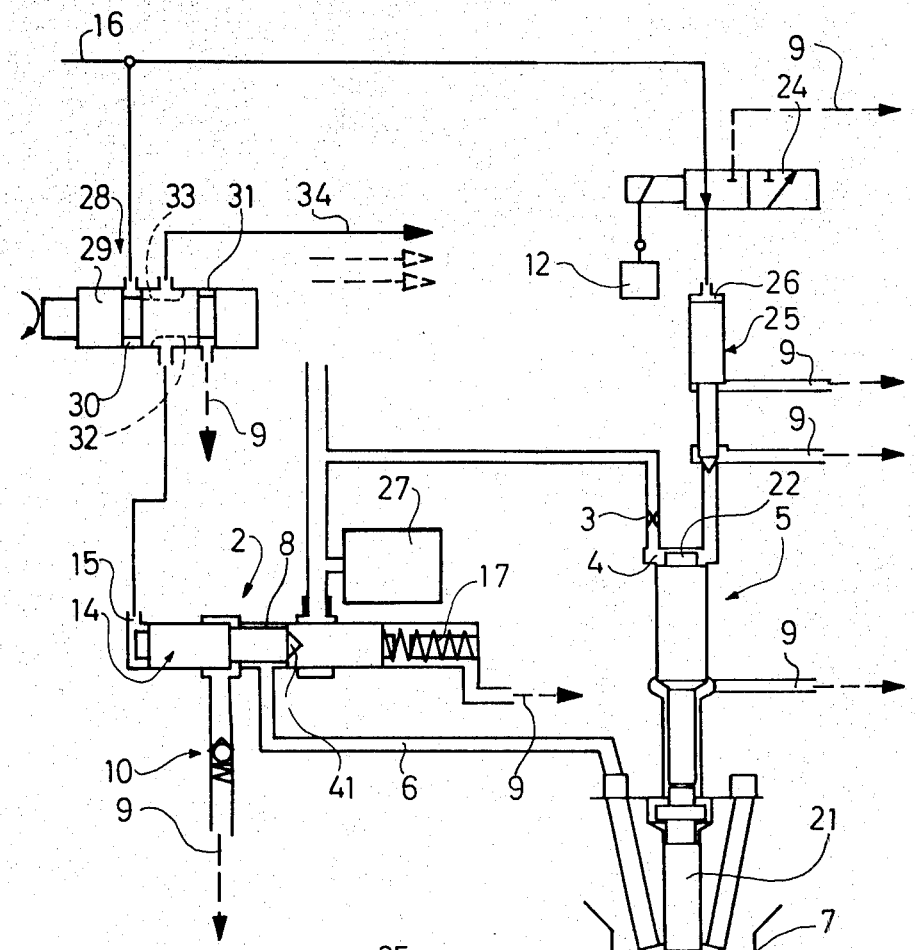
FIG. 2 is a schematic representation of a second embodiment of a fuel injection apparatus of the invention with control of the obturation mechanism via a distributor shaft.

In the embodiment of FIG. 2, the general arrangement is the same as in FIG. 1, with the exception of the magnetic valve 13. This magnetic valve 13 is replaced in the embodiment of FIG. 2 by a distributor 28. This distributor 28 has a mechanically driven distributor shaft 29, through which, when there are several fuel injection valves, all the obturation mechanisms 2 associated with the individual fuel injection valves 5 are controlled in synchronism with the required injection process. The design and the mode of operation of the distributor 28 are similar to those of distributor injection pumps, except that in this case the distributor shaft 29 has no pumping function, but rather has only a control function. To this end, there are two control grooves 30 and 31 on the distributor shaft 29. The control groove 30 is in constant communication with the return line 9. By means of the control slits 32, 33, shown in broken lines in FIG. 2, the actual control of the distributor shaft 29 is effected and shaft 29 rotates at the crankshaft speed in two-cycle engines and at half the crankshaft speed in four-cycle engines. In the embodiment of FIG. 2, the pressure chamber 15 of the obturation mechanism 2 is connected via the control slit 32 with the return line 9, while another line 34, which leads to a different obturation mechanism 2 (not shown) of a further fuel injection valve 5 (also not shown), is connected via the groove 30 and the control slit 33 with the servo pressure line 16. The control slits 32, 33 must be wide enough in comparison with the attachments leading to the pressure chamber 15 so that during the maximum duration of injection at full load, the pressurization of the pressure chamber 7 is assured. Then, however, the pressure chamber 7 is under pressure longer than necessary during idling. This is, however, only possible when there is an adaptation to the load with a particular control means for the obturation mechanism 2, as is described in connection with the exemplary embodiment of FIG. 1 described above and the embodiment of FIG. 4 described below.

Figure 3:
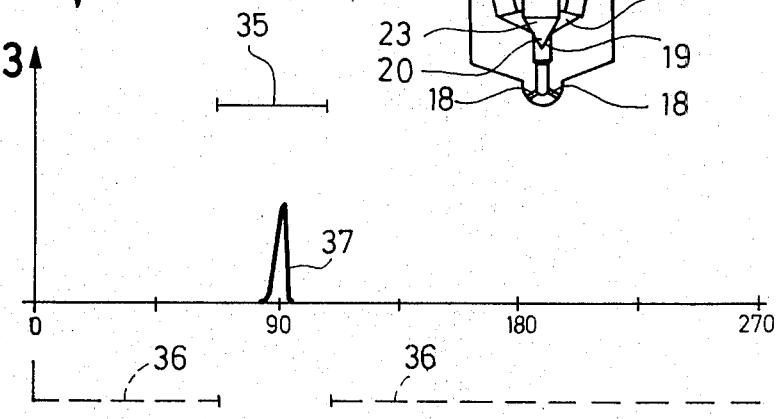
FIG. 3 is a graphic representation of the pressure in the pressure chamber and of the stroke of the valve body of a fuel injection valve across the control angle.

The pressurization of the pressure chamber 7 via the camshaft angle, for example, is illustrated in FIG. 3 by the line 35, while the broken line 36 indicates the low pressure level during the pauses between injections. The curve 37 represents the course of the stroke of the valve body 21, similarly in accordance with the crankshaft angle. In order to attain an undisturbed injection of fuel, the crankshaft angle associated with the pressurization of the pressure chamber 7 must be greater than the crankshaft angle associated with the injection. An optimal mutual adjustment of the two crankshaft angles at full load and partial load is possible with a construction in accordance with the embodiment of FIG. 4.

Figure 4:
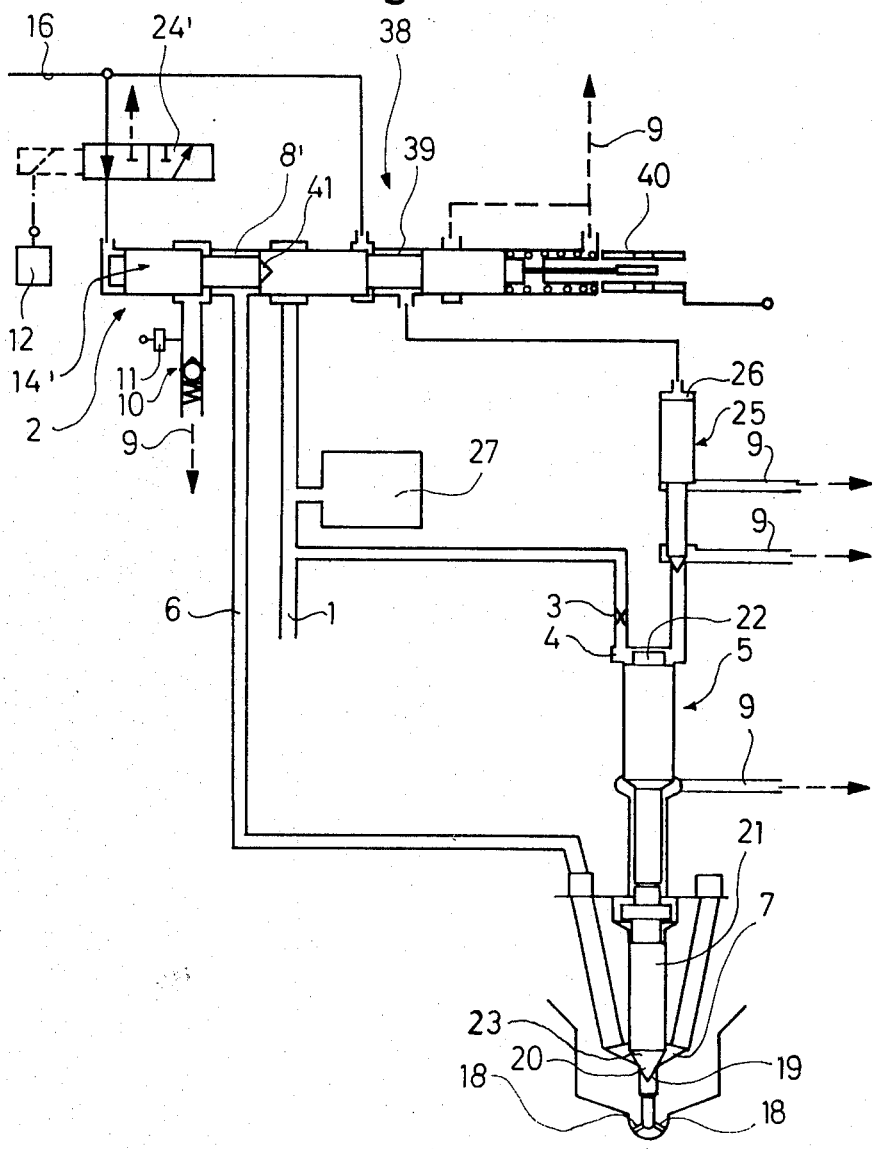
FIG. 4 is a schematic representation of a third embodiment of the invention in which the obturation mechanism and the control slider which controls the injections of the fuel injection valve are included in a structural unit.

In the embodiment of FIG. 4, the control of the magnetic valves 13 and 24 are combined in a particular structural unit 38 for the purpose of controlling the obturation mechanism 2 and the auxiliary valve 25. Only one magnetic valve 24' is controlled by the control apparatus 12, which magnetic valve 24' in turn controls a control slider 14'. The control slider 14' is a component of a 6/2-way valve. It has a first control groove 8' and a second control groove 39. By means of the first control groove 8', as in the description of the first embodiment shown in FIG. 1, the pressurization of the pressure chamber 7 takes place, while the control of the auxiliary valve 25 takes place via the control groove 39. In the position of rest, the upper pressure chamber 26 communicates with the servo pressure line 16, while in the working position, the upper pressure chamber 26 communicates with the return line 9. The actual injection takes place during the period of the working position.

In order to assure that the pressure chamber 7 is always subjected to the pressure of the fuel delivery line 1 before the auxiliary valve 25 opens, the control groove 8' is wider than the control groove 39. Naturally, the same advantages may be obtained by means of the provision of a reservoir chamber 27 and a warning transducer 11 as described in connection with the embodiment of FIG. 1.

Along with the control slider 14', an electric or electronic position feedback means 40 may also be provided, so that the position of the control slider 14' can be utilized for the control and monitoring of the fuel injection.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. A fuel injection apparatus for high-powered engines or the like and including at least one fuel injection valve having a housing with a valve body axially displaceable within the housing, a pressure chamber connected via a connecting line with a fuel delivery line, the valve body having a first face projecting into said pressure chamber and provided with a needle valve cooperating with a valve seat and a second face which is subjected to fuel pressure at the direction of a control means so that the valve seat is sealed by means of the needle valve and is pressure relieved at said second face to effect injection, whereby the valve body with its needle valve is lifted from the valve seat via said first face oriented toward the needle valve which is subjected to the injection pressure, the improvement which comprises:

an obturation mechanism provided in said fuel delivery line leading to said pressure chamber, a return line connected with said obturation mechanism, said obturation mechanism arranged to permit said connecting line leading to said pressure chamber to be selectively connected first with the fuel delivery line and then with said return line, and means for controlling said obturation mechanism in synchronism with the injection so that the connecting line between the pressure chamber and the fuel delivery line is interrupted at least during a large portion of the pause between injections and is opened for a period which is somewhat longer than the duration of injection.

2. A fuel injection apparatus in accordance with claim 1 wherein said obturation mechanism comprises a control slider and means for servo-controlling said control slider.

3. A fuel injection apparatus in accordance with claim 1 including a check valve within said return line.

4. A fuel injection apparatus in accordance with claim 3 wherein said check valve is adapted to maintain a minimum pressure in said pressure chamber during the pauses between injections.

5. A fuel injection apparatus in accordance with claim 2 wherein said control slider is provided with a throttle cross section.

6. A fuel injection apparatus in accordance with claim 5 wherein said throttle cross section is only effective in the opening phase when said fuel delivery line is connected with said pressure chamber.

7. A fuel injection apparatus in accordance with claim 1 including a reservoir chamber disposed upstream of said obturation mechanism.

8. A fuel injection apparatus in accordance with claim 2 wherein said means for servo-controlling said control slider includes a magnetic valve and including control means for controlling said magnetic valve.

9. A fuel injection apparatus in accordance with claim 1 wherein said obturation mechanism is adapted to connect at least briefly with said return line after injection has taken place.

10. A fuel injection apparatus in accordance with claim 9 wherein said pressure chamber is capable of being connected by said obturation mechanism only briefly with said return line after injection has taken place and including a warning transducer which transmits a signal whenever the pressure in said connecting line leading to the pressure chamber falls below a minimum level.

11. A fuel injection apparatus in accordance with claim 10 wherein said warning transducer is disposed within said return line upstream of said check valve.

12. A fuel injection apparatus in accordance with claim 2 which includes at least two fuel injection valves with mutually out-of-phase injection timing, and wherein said means for servo-controlling said control slider comprises a mechanical distributor.

13. A fuel injection apparatus in accordance with claim 12 wherein said distributor includes a rotating distributor shaft coupled with the engine crankshaft and provided with control slits and control grooves, said control slider being provided with a pressure chamber, a servo pressure line, said control slits and control grooves being arranged to connect said control slider pressure chamber with said servo pressure line for a period which is somewhat longer than the duration of injection, and thereafter to connect said control slider pressure chamber at least briefly with the approximately pressureless return line.

14. A fuel injection apparatus in accordance with claim 1 wherein said servo-controlled control slider comprises a $\frac{2}{3}$-way valve.

15. A fuel injection apparatus in accordance with claim 1 including an auxiliary valve, control means for controlling the valve body of the fuel injection valve via said auxiliary valve and a magnetic valve for controlling said auxiliary valve.

16. A fuel injection apparatus in accordance with claim 15 wherein said magnetic valve which controls said auxiliary valve and said control slider which controls the pressure relief of said pressure chamber are embodied as a structural unit and including a magnetic valve for servo-controlling said structural unit.

17. A fuel injection apparatus in accordance with claim 16 wherein said structural unit comprises a 6/2-way valve.

18. A fuel injection apparatus in accordance with claim 17 wherein said structural unit includes a control slider having control grooves, whereby the connecting line to the pressure chamber of the fuel injection valve is adapted to be connected by one of said control grooves alternatively with said fuel delivery line or with said return line, and an upper pressure chamber of the auxiliary valve is adapted to be connected by means of the other of said control grooves alternatively with said servo pressure line or with said return line whereby the overlap of the control grooves by the control edges is smaller in the case of said one control groove than in the case of said other control groove.

19. A fuel injection apparatus in accordance with claim 18 including position feedback means and wherein said position feedback means is actuatable via said control slider.

20. A fuel injection apparatus in accordance with claim 1 wherein said obturation mechanism comprises a mechanically controlled distributor.

* * * * *